United States Patent [19]

Horowitz et al.

[11] 4,114,406

[45] Sep. 19, 1978

[54] WASHING MACHINE

[75] Inventors: Alexandre Horowitz; Georg Rudolph Wolter Kymmell; Johannes Krijne, all of Eindhoven, Netherlands; Bernard Joseph Beusink, deceased, late of Oerle, Netherlands, by Friedrich Jacobus De Haan, administrator, Dommelen, Netherlands

[73] Assignee: U.S. Philips Corporation, New York, N.Y.

[21] Appl. No.: 786,046

[22] Filed: Apr. 8, 1977

[30] Foreign Application Priority Data

Apr. 12, 1976 [NL] Netherlands ..... 7603833

[51] Int. Cl.[2] ..... D06F 23/06

[52] U.S. Cl. ..... 68/24; 68/140; 366/220

[58] Field of Search ..... 68/23 R, 23.1, 24, 139, 68/140, 141, 142, 58, 27, 143; 366/220

[56] References Cited

U.S. PATENT DOCUMENTS

| | | | |
|---|---|---|---|
| 2,171,499 | 8/1939 | Busi | 68/140 X |
| 2,471,433 | 5/1949 | Kahn | 68/24 |

FOREIGN PATENT DOCUMENTS

| | | | |
|---|---|---|---|
| 991,823 | 6/1951 | France | 68/140 |

*Primary Examiner*—Philip R. Coe

*Attorney, Agent, or Firm*—Frank R. Trifari; Rolf E. Schneider

[57] ABSTRACT

A laundry washing machine which comprises a driven laundry holder rotatably mounted within a separately rotatable driven washing liquid container, the respective axes of rotation of the holder and the container intersecting each other.

5 Claims, 3 Drawing Figures

WASHING MACHINE

This invention relates to a laundry washing machine which comprises a washing liquid container in which a laundry holder having a wall which is permeable to washing liquid is mounted so as to be rotatable, the washing liquid container being also rotatable.

Such a washing machine with a cylindrical container and a cylindrical holder is for example described in German Patent Application No. 1,485,008. The container is there rotatable about an eccentric axis and the axes of rotation of the container and the holder extend in parallel and vertically. Owing to the rotation of both the container and the holder inertial forces are produced which promote the washing action.

Owing to the eccentric rotation of the container this known washing machine has a comparatively large volume, whilst during rotation about a vertical axis the position once assumed by the laundry in the holder changes little and the laundry is hardly mixed.

The present invention relates to a washing machine of the above mentioned type in which these disadvantages are eliminated and is characterized in that the container and the holder are substantially spherical bodies and their axes of rotation intersect each other.

The spherical bodies enable an effective use of the space in the washing machine, whilst owing to the intersecting axes the distance of the laundry to the axis of rotation of the container changes appreciably, so that the laundry can assume a different position in the holder under the influence of the changing forces acting on it, which promotes the washing action.

A preferred embodiment is characterized in that the axes of rotation intersect each other at an angle of approximately 60°. Furthermore it is of advantage that the axis of rotation of the container is vertical or substantially vertical.

Preferably, the speed of rotation of the container lies between 150 and 220 revolutions per minute and the holder rotates about its own axis of rotation with a speed of not more than 20 revolutions per minute. A further advantage is that the speed of rotation of the holder is adjustable. This enables the washing process to be adapted to the nature of the laundry.

Further suitable characteristic features will be apparent from the following description of preferred embodiments of the invention.

Figure 1:
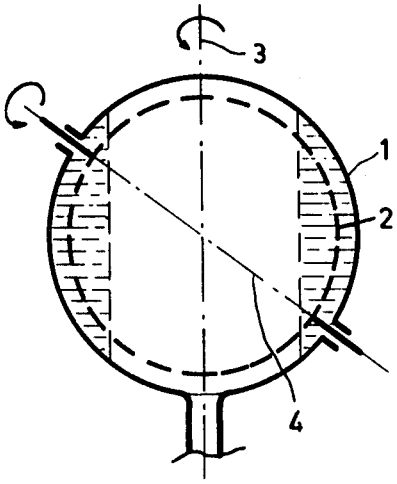
FIG. 1 is a schematic longitudinal section of a washing liquid container with a laundry holder.

The principle on which the invention is based is preferably explained with reference to FIG. 1, which shows the washing liquid container 1 and the laundry holder 2 in relation to each other. The spherical container 1 is made of a sheet metal and is rotatable about an axis 3. The holder 2, which is also spherical, is made of a perforated sheet metal (the perforated wall is represented by a dashed line) and is rotatable about a shaft 4 which is journalled in the container 1. The two spherical bodies are concentric and the two axes of rotation 3 and 4 intersect each other.

If, after washing liquid has been introduced into the container 1 and the holder 2 has been loaded with laundry, the container is rotated rapidly, the liquid will be distributed approximately cylindrically along the wall of the holder parallel to the axis of rotation, as is indicated by the shaded area. If the holder 2 is now rotated relative to the container 1, the laundry in the holder is alternately forced into the liquid cylinder and lifted out of the liquid, the liquid being driven out of the laundry. Thus, a very intensive washing action is obtained.

As the axes of rotation 3 and 4 intersect each other, the distance of the laundry to the axis of rotation of the container fluctuates substantially, the laundry even passing through a zone in which owing to the rotation of the reservoir no or a slight inertial force is exerted on the laundry, so that this laundry may assume a different position in the holder under the influence of gravity. Thus, a certain degree of redistribution of the laundry in the holder may be obtained, which improves the washing process. The container and the holder described hereinbefore are utilized in the embodiments of washing machines in accordance with FIGS. 2 and 3.

Figure 2:
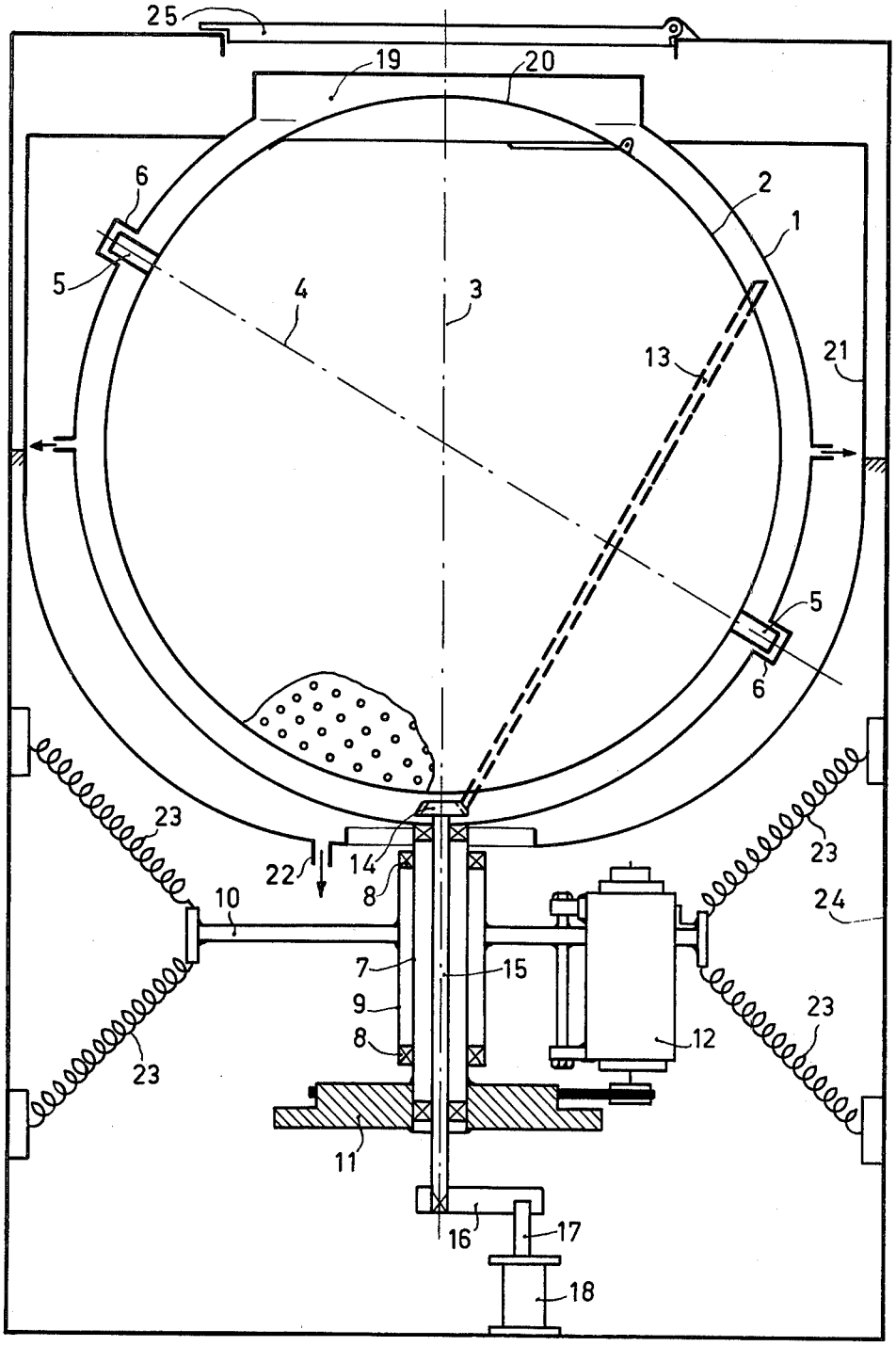
FIG. 2 is a schematic longitudinal section of an embodiment of a washing machine with a container and a holder in accordance with FIG. 1.

In FIG. 2 the spherical washing liquid container is again designated 1, whilst the spherical laundry holder which is made of a perforated material is designated 2. The holder 2 is journalled in the container 1 by journals 5 and bearings 6. The axis of rotation 3 of the container is vertical and the axis of rotation 4 of the holder intersects the axis of rotation of the container at an angle of 60°. The container is equipped with a hollow drive shaft 7, which is journalled with bearings 8 in a hollow shaft 9, which is mounted in the frame 10. A pulley 11, which can be driven by an electric motor 12 is rigidly connected to the hollow shaft 7.

On its periphery the holder 2 is provided with a gear ring 13 which engages with a pinion 14 which is mounted on a shaft 15 which is journalled in the hollow shaft 7. The transmission ratio between the pinion 14 and the gear ring 13 is selected so that when the container has a speed of 180 to 190 revolutions per minute the holder 2 has a speed of approximately 16 revolutions per minute about its axis of rotation when the shaft 15 is stopped. This is the case when the lever 16, which is rigidly connected to the shaft 15, is retained by a stop, in the present instance the armature 17 of a non-energized electromagnet 18.

The container 1 has an opening 19 at its top, which can be closed by a lid. This opening enables both the laundry and the washing liquid to be introduced into the machine. The holder 2 is provided with a lid 20. Around the container 1 a vessel 21 is mounted for receiving the washing liquid after termination of the washing process and for draining this liquid, for which purpose a drain pipe 22 is provided which may be connected to a drain pump (not shown).

The frame 10, which carries the container 1 and the holder 2 as well as the driving elements, is mounted in a housing 24 by means of springs 23. This housing is provided with an access cover 25 at the top. The vessel 21 is also rigidly connected to the housing 24.

In practice it has been found that for a diameter of the container of 45 cm and with the previously stated operating speed a load of 4.5 kg of laundry can be washed with an amount of water of 20 liters at the most, which is substantially less than has been attainable so far with conventional washing machines.

The speeds of the two bodies 1 and 2 can be rendered adjustable by conventional means such as a gear transmission or by the use of a variable-speed motor. Thus, the washing process can be adapted to the nature of the laundry.

When the machine is also adapted for spin-drying of the laundry, it is desirable not only to incorporate provisions which enable the desired speed of rotation of the container to be attained, such as a pole-change motor or a controllable d.c. motor, but it must also be possible for the drive system of the holder 2 to be disengaged. In the present example this has been realized by enabling the shaft 15 with the pinion 14 to rotate along with the container 1 and the shaft 7 which is connected thereto. For this purpose the electromagnet 18 is energized, so that the lever 16 is no longer retained by the armature 17 of the magnet.

Figure 3:
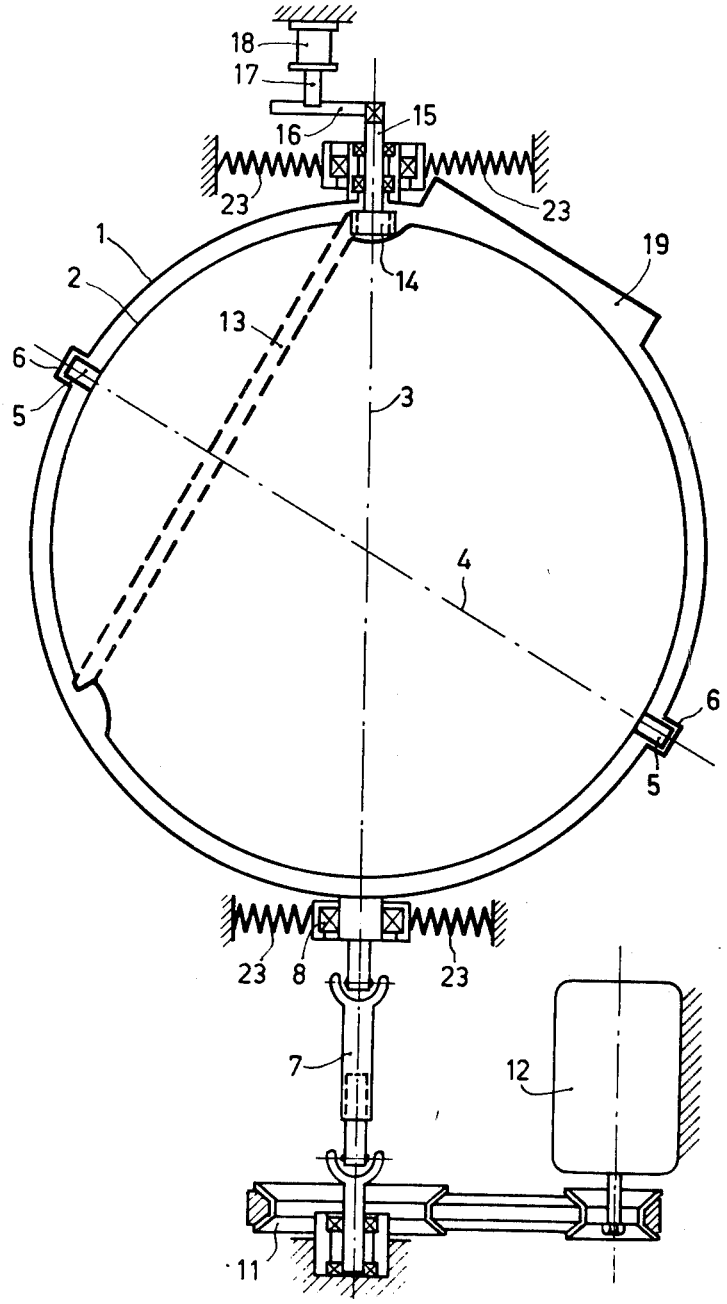
FIG. 3 is a schematic longitudinal section of a different embodiment of a washing machine with a container and a holder in accordance with FIG. 1.

The construction of the machine in accordance with the embodiment of FIG. 3 basically corresponds to that of FIG. 2. The reference numerals in FIG. 3 are the same as those of the corresponding parts in FIG. 2.

The container 1 and the laundry holder 2 are again supported by springs 23, which in this case are mounted both above and underneath the container. The container 1 is driven by the motor 12 via a pulley 11 and the shaft 7 connected to the container 1, which shaft takes the form of a cardan shaft.

The pinion 14 which is in engagement with the gear ring 13 of the laundry holder 2 is located at the top and is mounted on the shaft 15 which is in line with the shaft 7. The electromagnet 18 is also located at the top. The access opening of the container 1 is no longer disposed in a horizontal plane, but is inclined relative to this plane, which adds to the ease of operation of the machine.

It will be evident to those skilled in the art that several further embodiments are possible within the scope of the invention. As an example, the shafts 7 and 15 may be disposed horizontally and the access opening 19 of the container 1 may be in a vertical plane.

What is claimed is:

1. A laundry washing machine which comprises a substantially spherical washing liquid container, means to mount said container on a first shaft for rotation about a first diametrical axis, first means to rotate said container about said first axis, a substantially spherical laundry holder having a wall permeable to washing liquid, means to mount said holder within said container for rotation about a second diametrical axis, and second means to rotate said holder about said second axis, the two axes of rotation intersecting each other.

2. A washing machine according to claim 1, in which the two axes of rotation intersect each other at an angle of approximately 60°.

3. A washing machine according to claim 1, in which the axis of rotation of the container is vertical or substantially vertical.

4. A washing machine according claim 1, in which the holder is provided with a gear ring for engagement with a pinion on a second shaft concentric with the first shaft.

5. A washing machine according to claim 1, in which the two rotating means are constituted by a single electric motor.

* * * * *